United States Patent [19]

Menge

[11] 4,339,903

[45] Jul. 20, 1982

[54] METAL CROSS SUPPORT

[76] Inventor: Richard J. Menge, 4103 Anchor Dr., Brighton, Mich. 48116

[21] Appl. No.: 48,274

[22] Filed: Jun. 13, 1979

Related U.S. Application Data

[63] Continuation of Ser. No. 862,038, Dec. 19, 1977, abandoned.

[51] Int. Cl.[3] ..... E04C 2/38

[52] U.S. Cl. ..... 52/657; 52/693

[58] Field of Search ..... 52/693, 690, 317, 657, 52/779, 732, DIG. 6; 85/11

[56] References Cited

U.S. PATENT DOCUMENTS

| | | | |
|---|---|---|---|
| 1,649,226 | 11/1927 | Gstalder | 52/DIG. 6 |
| 2,302,101 | 11/1942 | Boydstun | 52/657 X |
| 3,214,802 | 11/1965 | Davis | 85/11 X |
| 3,591,997 | 7/1971 | Tennison, Jr. | 52/657 |
| 3,875,719 | 4/1975 | Menge | 52/669 |
| 4,016,698 | 4/1977 | Rogers | 52/656 |
| 4,157,002 | 6/1979 | Adolph | 52/693 |

FOREIGN PATENT DOCUMENTS

| | | | |
|---|---|---|---|
| 484192 | 6/1977 | Australia | 52/693 |

*Primary Examiner*—Price C. Faw, Jr.
*Assistant Examiner*—Carl D. Friedman
*Attorney, Agent, or Firm*—Gifford, VanOphem, Sheridan & Sprinkle

[57] ABSTRACT

A metal cross support is provided for use with a wooden truss structure of the type having a plurality of spaced wooden truss elements with a wooden stringer extending across at least one end of the truss elements and generally perpendicular thereto. A narrow and transversely extending channel is formed in each truss element so that the channels are in alignment with each other. The cross support comprises an elongated strip having a portion which is insertable into the aligned channel so that upon insertion, the metal strip is frictionally attached to the wooden truss elements. In addition, an overlapping portion at at least one end of the metal strip lies in a horizontal plane, abuts against and is attached to a corresponding horizontal surface.

8 Claims, 9 Drawing Figures

METAL CROSS SUPPORT

CROSS REFERENCE TO RELATED APPLICATIONS

This is a continuation of application Ser. No. 862,038, filed Dec. 19, 1977, now abandoned.

BACKGROUND OF THE INVENTION

I. Field of the Invention

The present invention relates to an improved metal cross support for a wooden building construction.

II. Description of the Prior Art

In constructing buildings, bridges and the like a wall section is typically formed by a plurality of spaced and parallel joists or truss elements. In addition, a stringer is secured across at least one and usually both ends of the truss elements so that the axis of the stringer extends substantially perpendicularly to the axes of the truss elements.

An important property of the truss elements and stringers, hereinafter referred to as a truss structure for simplicity, is strength and rigidity whereby the truss structure is able to prevent or minimize deflection of a floor or the like which it supports. A still further important property of such truss structures is that the structure remain square or rectangular despite the load imposed upon the structure. Oftentimes the previously known truss structures become rhomboid when subjected to heavy stress and load. It is for these reasons that a cross support is oftentimes employed with such truss structures.

One type of previously known truss cross support is described in U.S. Pat. No. 3,875,719 which issued on Apr. 8, 1975 and which is owned by the Assignee of the instant invention. In this previously known cross support the base leg of a T-shaped metal strip is inserted into a series of aligned and transversely extending grooves formed in the wooden truss elements. Thereafter, a nail is driven through the base leg of the metal strip and into the truss element which spreads the metal strip outwardly to frictionally engage the truss element.

This previously metal cross support, however, is disadvantageous for two reasons. First, the securement of the metal cross support to the stringer is minimal so that the distortion and deflection of the stringer under heavy stress can still occur.

Secondly, this previously known metal cross support is disadvantageous in that the securement of the metal strip to the truss elements by nails, while effective, requires nails and is time consuming in construction and, therefore, expensive in material and labor costs.

SUMMARY OF THE PRESENT INVENTION

The present invention overcomes the above mentioned disadvantages of the previously known metal cross support by providing such a cross support which enjoys increased strength and rigidity and which can be rapidly and simply secured to the truss structure.

In brief the metal cross support according to the present invention comprises a T-shaped elongated metal strip in which the base leg of the metal strip is insertable into a series of aligned slots or channels formed transversely across the truss elements. The base leg is dimensioned so as to frictionally engage the truss elements upon insertion into the aligned slots.

Suitable means are provided on at least one end and preferably both ends of the metal strip to secure the strip to a horizontal stringer element. In one form of the invention a horizontal overlapping portion at the end of the strip abuts against a corresponding horizontal surface on the stringer element of the truss structure and is secured thereto by nails or the like. In this fashion, the attachment of the overlapping portion of the metal cross support to the stringer provides increased rigidity and strength for the truss structure against deflection and distortion under high loads and stress.

Alternatively, a plurality of outwardly extending prongs are integrally formed with the strip at the ends which are driven into the stringer element to securely attach the strip to the stringer element.

In addition in the preferred form of the invention the base leg of the T-shaped metal cross support includes an outwardly projecting portion or portions which, upon insertion into the slot in the truss elements, bites into and attaches the metal strip to the truss elements. Therefore, the previously known necessity of nailing the metal cross support to the truss elements is eliminated with its associated costs.

BRIEF DESCRIPTION OF THE DRAWINGS

A better understanding of the present invention will be had upon reference to the following detailed description when read in conjunction with the accompanying drawings, wherein like reference characters refer to like parts throughout the several views, and in which.

DETAILED DESCRIPTION OF THE PRESENT INVENTION

Figure 1:
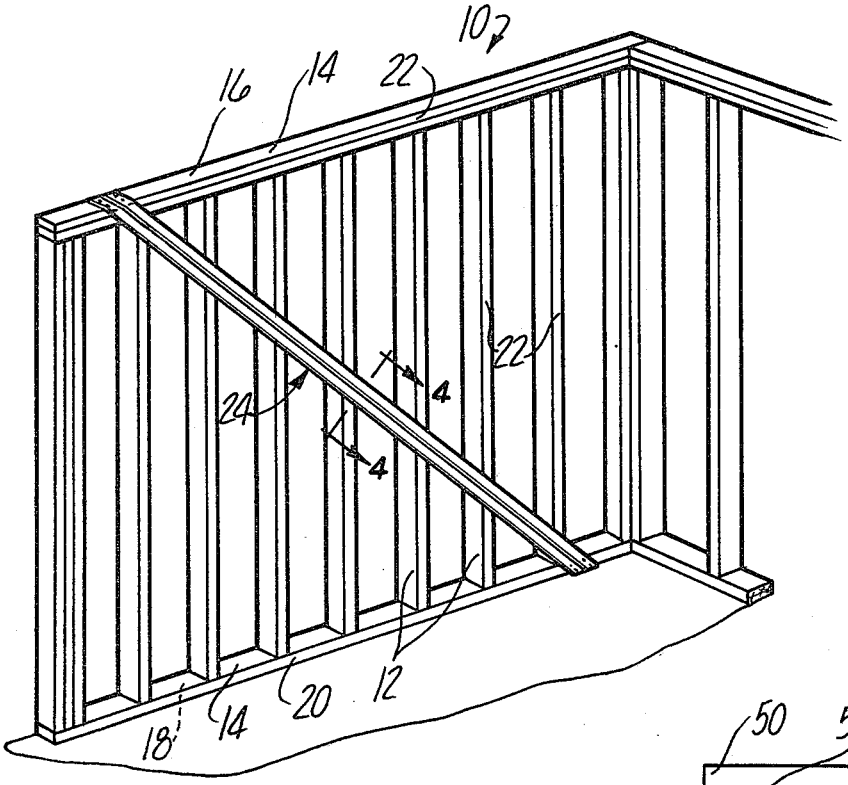
FIG. 1 is a fragmentary perspective view illustrating the metal cross support according to the present invention secured to a truss structure.

With reference first to FIG. 1, a truss structure 10 is thereshown and, for example, comprises a wall of a building construction. The truss structure 10 includes a plurality of spaced and parallel truss elements 12 which are vertically disposed. A stringer 14 is secured across at least one, and, preferably, both ends of the truss elements 12 so that the axis of the stringer 14 is substantially perpendicular to the axes of the truss elements 12. The upper stringer 15 has an upper horizontal surface 16 and the lower stringer 17 has a lower horizontal surface 18. In addition, in the conventional fashion, the inner edges 20 of the stringers 14 are flush with the inner edges 22 of the truss elements 12.

Still referring to FIG. 1, a one-piece metal cross support 24 according to the present invention is thereshown secured to the truss structure 10 in a manner which will be subsequently described in detail. However, as shown in FIG. 1, the cross support 24 extends transversely or diagonally across the truss structure 10 from the upper stringer 15 to the lower stringer 17.

Figure 3:
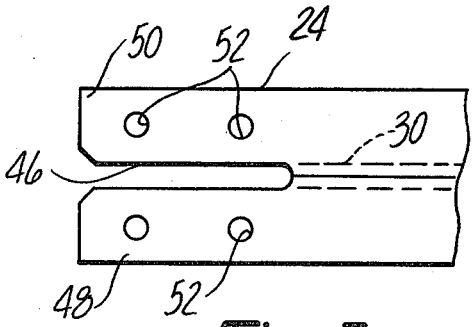
FIG. 3 is a fragmentary plan view of one end of the metal cross support of the present invention during one stage of its construction.

With reference now to FIGS. 1–4, the cross support 24 is generally T-shaped in cross section having a narrow and generally U-shaped base leg or base leg portion 30 and upper flange portions 32 and 34. The base leg portion 30 of the cross support 24 extends substantially for the entire length of the cross support 24 but terminates short of the end as shown in FIG. 3.

The base leg portion 30 is received within a narrow slot or channel 36 formed in the truss elements 12 and in the stringers 14. The channels 36 are in alignment with each other so that upon insertion of the base leg 30 of the cross support 24 into the aligned channels 36, the inside surfaces 40 and 42 of the flange portions 32 and 32 flatly abut against the inside surfaces 20 and 22 of the stringers 14 and truss elements 12 respectively.

Preferably the width of the cross support base leg 30 is slightly larger than the width of the channel 36 so that the base leg 30 must be press fit or hammered into the slots 36. In doing so, the base leg 30 frictionally engages and attaches the cross support 24 to the truss elements 12 and stringers 14 by slightly compressing the wooden truss element 12 around the slot 36. The frictional attachment of the base leg 30 to the truss element 12 thus eliminates the previously known nailed attachment between the cross support 24 and the truss structure 10.

Figure 2:
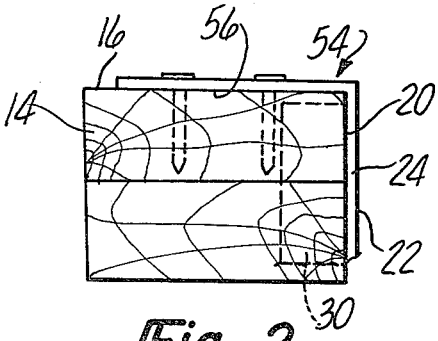
FIG. 2 is a fragmentary sectional view taken substantially along line 2—2 in FIG. 1 and enlarged for clarity.
Figure 4:
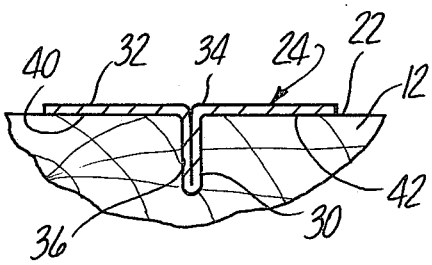
FIG. 4 is a cross-sectional view taken substantially along line 4—4 in FIG. 1 and enlarged for clarity.

With particular reference now to FIGS. 1–3, a central elongated slot 46 is formed in at least one and preferably both ends of the cross support 24. The longitudinal slot 46 thus eliminates the base leg 30 at the end of the cross support 24 and thereinstead forms a pair of spaced and parallel free ends 48 and 50 of the cross support 24. A pair of nail holes 52 are provided through each of the free ends 48 and 50.

Referring now particularly to FIGS. 1 and 2, in one form of the invention the free ends 48 and 50 of the cross support 24 are bent substantially perpendicularly over the upper horizontal surface 16 of the stringer 14 and form an overlapping portion 54. The lower surface 56 of the overlapping portion 54 is substantially horizontal as shown in FIG. 2 and flatly abuts against the horizontal surface 16 of the stringer member 14. Thus, the plane of the surface 56 is substantially perpendicular to the plane of the central portion of the metal cross support 24. Thereafter, nails 58 are driven through the nail holes 52 and into the stringer element 14 in order to firmly attach the overlapping portion 54 to the stringer element 14.

The overlapping portion 54 provides increased structural rigidity and strength for the truss structure 10 by securing the cross support 24 not only along the side 22 of the stringer 14 but also across its top surface 16 as shown at FIG. 2. In practice it has been found that this increased strength and rigidity is sufficient to prevent deflection and distortion of the truss support 10 under considerably heavier loads and stresses than without the overlapping portion 54.

Figure 9:
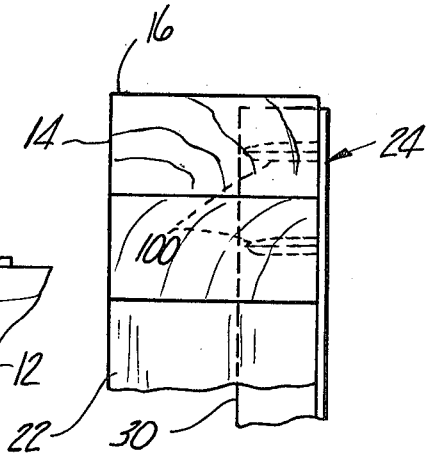
FIG. 9 is a fragmentary sectional view similar to FIG. 2 but showing a modification thereof.

An alternative to the overlapping portion 54 at the end or ends of the strip 24 is shown in FIG. 9 in which a plurality of prongs 100 extend perpendicularly outwardly from the strip 24 at one or both ends of the strip 24. The prongs are preferably formed by punching so that the prongs 100 are integral with the strips 24 and pointed at their outer end. Thus, the strip 24 can be simply and rapidly attached to the stringer 14 by hammering the prongs 100 into the stringer 14.
14.

Figure 5:
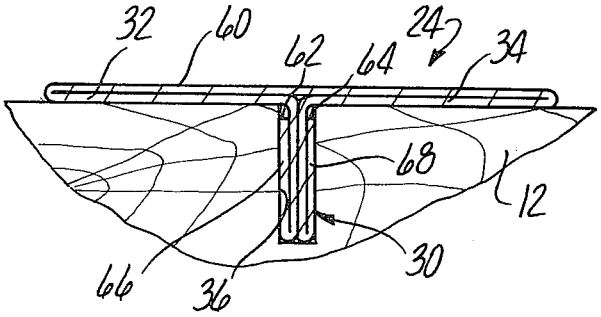
FIG. 5 is a cross-sectional view similar to FIG. 4 but showing a modification thereof.

With reference now to FIG. 5, a modification of the metal cross support 24 according to the present invention is thereshown in which an overlapping metal layer 60 is provided across the flange portions 32 and 34 and in which the base leg 30 of the cross support 24 includes a pair of overlapping outer metal layers or portions 66 and 68 having upper free ends 62 and 64, respectively. The modification of the support strip 24 illustrated in FIG. 5 provides increased strength and rigidity over the cross support illustrated in FIG. 4. However, unlike the embodiment illustrated in FIG. 4, the free ends 62 and 64 of the base leg outer layers 66 and 68 abut against the slot 36 in the truss element 12. Thus, due to the press fit between the base leg 30 and the slot 36, the free ends 62 and 64 bite or dig into the truss element 12 in the slot 36 to thereby securely frictionally attach the base leg 30 to the truss element 12. In order to insure this frictional engagement, preferably the free ends 62 and 64 are spaced slightly downwardly from their respective flange portions 32 and 34.

Figure 6:
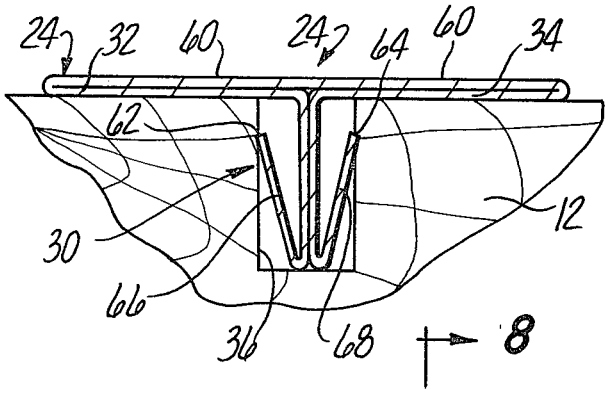
FIG. 6 is a cross-sectional view similar to FIG. 4 but showing still a further modification thereof.

With reference now to FIG. 6 a still further modification of the metal cross support 24 according the present invention is thereshown. The cross support 24 in FIG. 6 differs from that shown in FIG. 5 in that the base leg portions 66 and 68 are flared outwardly and form a generally W-shaped base leg 30. The outer portions 66 and 68 can bend inwardly upon insertion of the cross support base leg 30 into the slot 36 after which the outer portions 66 and 68 flex outwardly so that the free ends 62 and 64 bite into the truss element 12 within the slot 36 and securely frictionally attach the cross support 24 to the truss structure 10.

Figure 7:
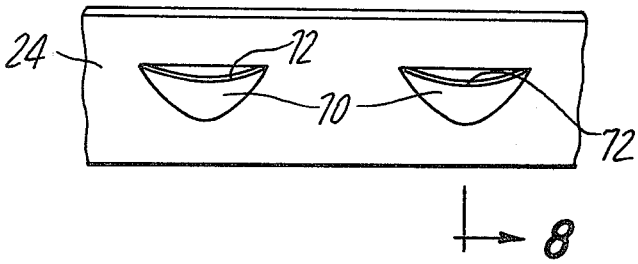
FIG. 7 is a fragmentary side plan view illustrating a modification of the metal cross support according to the present invention.
Figure 8:
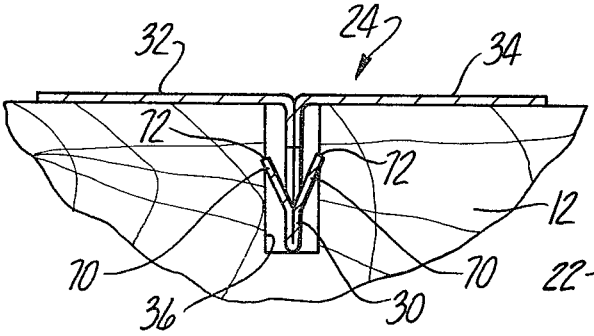
FIG. 8 is a fragmentary sectional view taken substantially along line 8—8.

With reference now to FIGS. 7 and 8, still a further modification of the metal cross support 24 is thereshown. The cross support 24 illustrated in FIGS. 7 and 8 is similar to that shown in FIG. 4 and thus comprises a central base leg portion 30 having a pair of flange portions 32 and 34 which abut against the truss element 12. Unlike the embodiment illustrated in FIG. 4, however, longitudinally spaced portions 70 with upper free edges 72 are stamped or otherwise pressed outwardly from the base leg 30. Upon insertion of the base leg 30 into the slot 36, the free edges 72 of the portions 70 bite into and frictionally attach the cross support member 24 to the truss structure.

From the foregoing it can be see that the metal cross support 24 according to the present invention provides substantial and increased strength over the previously known cross supports of its type by the provision of the overlapping portion 54 and its securement to the stringer 14. In addition, since the base leg 30 of the cross support 24 frictionally attaches the cross support 24 to the truss structure 10 upon its insertion into the aligned slots 36, the previously known necessity of nailing the base leg 30 to the truss structure 10 is totally eliminated.

Having described my invention, however, many modifications thereto will become apparent to those skilled in the art to which it pertains without deviation from the spirit of the invention as defined by the scope of the appended claims.

I claim:

1. In a wooden truss structure or the like for supporting structural elements the improvement which comprises:

a plurality of spaced wooden truss elements, a wooden stringer element extending across at least one end of said truss element and generally perpendicular thereto, a narrow transversely extending channel in each truss element, said channels being in alignment with each other, a metal support strip having a base leg which is positioned in said channels, means for securing said base leg in said channel, means for bending an end of said strip in the direction of said base leg, said means for bending comprising a flat overlapping portion formed at at least one end thereof by removal of a segment of said base leg from said at least one end so that one surface of said overlapping portion lies in a substantially horizontal plane and flatly abuts against a substantially horizontal surface of said stringer element, and means for attaching said overlapping portion to said stringer element.

2. The invention as defined in claim 1 wherein said overlapping portion comprises a pair of spaced and parallel longitudinal flange portions having a longitudinal slot formed therebetween from the removal of said segment of the base leg.

3. The invention as defined in claim 1 wherein said strip includes at least one outwardly extending prong formed integrally therewith on at least one end of said strip, said prong being adapted to be driven into said stringer element to thereby secure the end of said strip to the stringer element.

4. In a wood frame truss structure including a series of parallel spaced wooden truss members having relatively aligned grooves provided transversely thereacross and a metal cross bracing member received in part within said grooves and fastened to one or more of said truss members, the improvement comprising:

a metal cross bracing member formed to include a depending flange bent back on itself for added structural strength and to provide a width and depth for tight fitted engagement in the aligned grooves in said truss members;

said depending flange also including a means provided on at least one side thereof and extending continuously along the full length thereof for further enhancing the structural rigidity of said bracing member and for tight fitting self-locking engagement thereof in said truss member grooves; and wherein said last mentioned means comprises the depending flange of said metal cross bracing member being larger in width than said grooves so that said depending flange contacts each groove along the entire length of each groove.

5. In the wood frame truss structure of claim 4, said metal cross bracing member having said means provided continuously along both side walls of said depending flange.

6. In the wood frame truss structure of claim 5, wherein said bracing member has a top and wherein said depending flange has a free end and a return bent portion folded such that said free end is spaced somewhat from said top.

7. In a wooden truss structure or the like for supporting structural elements the improvement which comprises:

a plurality of spaced wooden truss elements, a first wooden stringer element extending across one end of said truss element and generally perpendicular thereto, a second wooden stringer element extending across the opposite end of said truss element and generally perpendicular thereto, a narrow transversely extending channel in each truss element, said channels being in alignment with each other, a metal support strip having a base leg which is positioned in said channels, means for securing said metal strip portion in said channel, means for bending both ends of said strip in the direction of said base leg, said means for bending comprising a first flat overlapping portion formed at one end thereof by removal of a first segment of said base leg from said one end so that one surface of said overlapping portion lies in a substantially horizontal plane and flatly abuts against a substantially horizontal surface of said first stringer element, said means for bending further comprising a second flat overlapping portion formed at the other end thereof by removal of a second segment of said base leg from said other end so that one surface of said second overlapping portion lies in a substantially horizontal plane and flatly abuts against a substantially horizontal surface of said second stringer element, and means for attaching said overlapping portions to said stringer elements.

8. In the wood frame truss structure of claim 6, wherein said free end is spaced apart from said depending flange to further enhance tight fitting self-locking engagement in said truss member grooves by allowing said free ends to bite into the truss members at said grooves.

* * * * *

UNITED STATES PATENT AND TRADEMARK OFFICE

CERTIFICATE OF CORRECTION

PATENT NO. : 4,339,903

DATED : July 20, 1982

INVENTOR(S) : RICHARD J. MENGE

It is certified that error appears in the above—identified patent and that said Letters Patent is hereby corrected as shown below:

Column 3, line 19, after "flange portions " delete "32 and 32" and insert thereinstead --32 and 34--.

Column 6, line 27, delete "metal strip portion" and insert thereinstead --base leg--.

Signed and Sealed this

*Fourteenth* Day of *December 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,339,903

DATED : July 20, 1982

INVENTOR(S) : Richard J. Menge

It is certified that error appears in the above—identified patent and that said Letters Patent is hereby corrected as shown below:

Column 4, line 3, delete "14".

Claim 2, line 5, the line beginning "segment of", delete "the" and insert --said-- therefor.

Claim 3, line 5, the line beginning "stringer element", delete "the" and insert --said-- therefor.

Claim 3, line 6, the line beginning "to the stringer", delete "the" and insert --said therefor.

Claim 7, line 16, the line beginning "means for securing", delete "metal strip portion" and insert --base leg-- therefor.

Claim 8, line 5, the line beginning "said free ends", delete "the" and insert --said-- therefor.

Figures 1,2 and 6 should appear as shown on the attached sheet.

Signed and Sealed this

*Seventh* Day of *June 1983*

[SEAL]

*Attest:*

DONALD J. QUIGG

*Attesting Officer*

*Acting Commissioner of Patents and Trademarks*

UNITED STATES PATENT AND TRADEMARK OFFICE

CERTIFICATE OF CORRECTION

PATENT NO. : 4,339,903

DATED : July 20, 1982

INVENTOR(S) : Richard J. Menge

It is certified that error appears in the above-identified patent and that said Letters Patent is hereby corrected as shown below:

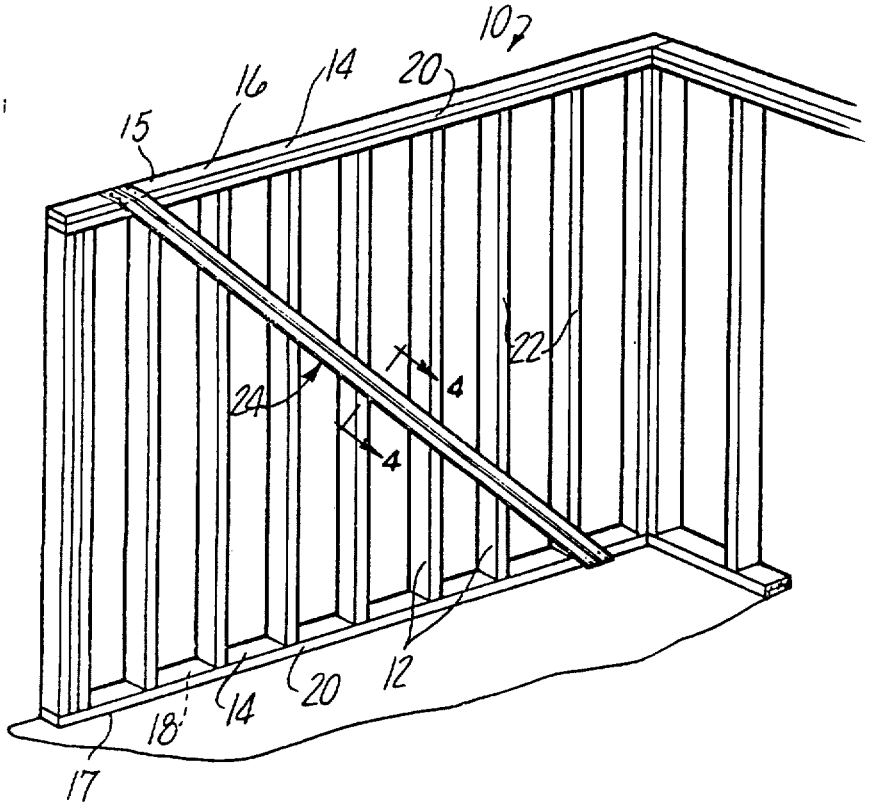

Fig-1

UNITED STATES PATENT AND TRADEMARK OFFICE

CERTIFICATE OF CORRECTION

PATENT NO. : 4,339,903

DATED : July 20, 1982

INVENTOR(S) : Richard J. Menge

It is certified that error appears in the above-identified patent and that said Letters Patent is hereby corrected as shown below:

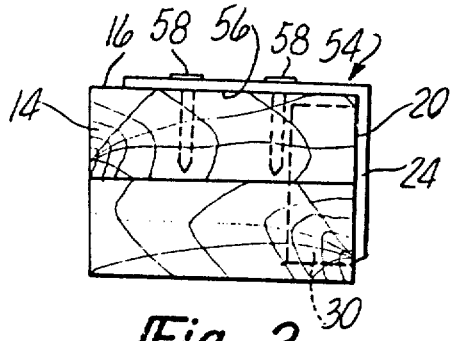

Fig-2

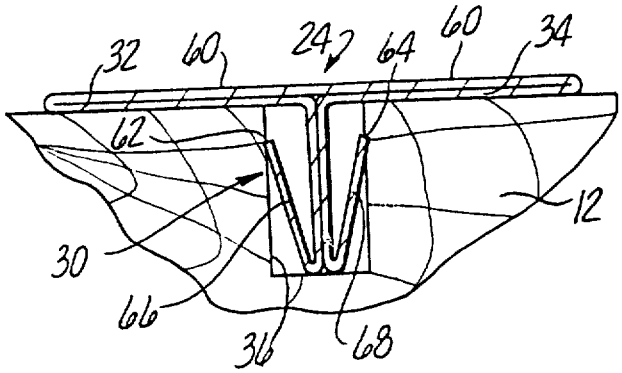

Fig-6